United States Patent [19]

Kneezel et al.

[11] Patent Number: 4,980,702

[45] Date of Patent: Dec. 25, 1990

[54] TEMPERATURE CONTROL FOR AN INK JET PRINTHEAD

[75] Inventors: Gary A. Kneezel, Webster; Daniel R. Blessington, Pittsford, both of N.Y.

[73] Assignee: Xerox Corporation, Stamford, Conn.

[21] Appl. No.: 458,013

[22] Filed: Dec. 28, 1989

[51] Int. Cl.[5] ..... B41J 2/05

[52] U.S. Cl. ..... 346/140 R; 338/308

[58] Field of Search ..... 346/140; 338/308

[56] References Cited

U.S. PATENT DOCUMENTS

| | | | |
|---|---|---|---|
| 4,125,845 | 11/1978 | Stevenson, Jr. | 346/140 |
| 4,250,512 | 2/1981 | Kattner et al. | 346/140 |
| 4,496,824 | 1/1985 | Kawai et al. | 219/216 |
| 4,532,530 | 7/1985 | Hawkins | 346/140 |
| 4,571,598 | 2/1986 | Shinozaki et al. | 346/76 |
| 4,636,812 | 1/1987 | Bakewell | 346/76 |
| 4,686,544 | 8/1987 | Ikeda et al. | 346/140 |
| 4,704,620 | 11/1987 | Ichihashi et al. | 346/140 |
| 4,719,472 | 1/1988 | Arakawa | 346/140 |
| 4,723,129 | 2/1988 | Endo | 346/140 X |
| 4,791,435 | 12/1988 | Smith et al. | 346/140 |
| 4,831,390 | 5/1989 | Deshpande | 346/140 |
| 4,899,180 | 2/1990 | Elhatem | 346/140 |

*Primary Examiner*—Joseph W. Hartary

[57] ABSTRACT

In a printhead die-bonded to a substrate, a recess, in a preferred embodiment, is formed in the substrate and layers of resistive material separated by a dielectric layer are formed in the recess by a thick film screen print process. The recess underlies the printhead which remains bonded to the substrate along the edges of the recess. This arrangement provides good proximity of the heater and the temperature sensor to the printhead enabling measurements to be made and sent to a control circuit which regulates heater operation to maintain the printhead within a desired operating range. The configuration also allows precise positioning of the printhead with the metal surface as a reference.

11 Claims, 4 Drawing Sheets

TEMPERATURE CONTROL FOR AN INK JET PRINTHEAD

BACKGROUND AND INFORMATION DISCLOSURE STATEMENT

This invention relates to a bubble ink jet printing system and, more particularly, to a printhead which is constructed so as to effectively control heat generated during the printing operation.

Bubble jet printing is a drop-on-demand type of ink jet printing which uses thermal energy to produce a vapor bubble in an ink-filled channel that expels a droplet. A thermal energy generator (printhead), is located in the channels near the nozzle a predetermined distance therefrom. A plurality of resistors are individually addressed with a current pulse to momentarily vaporize the ink and form a bubble which expels an ink droplet. As the bubble grows, the ink is ejected from a nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle in which the bubble is growing provides the momentum and velocity of the droplet in a substantially straight line direction towards a recording medium, such as paper.

A problem with prior art printhead operation is the increase in temperature experienced by a printhead during an operational mode. With continued operation, the printhead begins to heat up, and the diameter of the ink droplet begins to increase resulting in excessive drop overlap on the recording media thereby degrading image quality. As the printhead experiences a further heat buildup, the ink temperature may rise to a point where air ingestion at the nozzle halts drop formation completely. It has been found that, at about 65° for a typical ink, printhead operation becomes unreliable. There is also a lower temperature limit for reliable operation which varies for different inks and device geometries. This limit might, for example, be about 20° C. for an ink and device designed to function reliably up to, for example, 60° C. At the same time, it is desirable to offer an extended range of ambient operating temperatures, such as 5° C. to 35° C., so that it will be necessary to provide for warming up the printhead. It is also desirable to minimize the time required to warm up the printhead, so that first copy (print) out time is acceptable. The printhead characteristics and machine environment requirements have the following impact on the thermal design of the system. The generation of heat during operation (which becomes a greater problem as print speed, duration, and density increase) makes it necessary that the printhead be connected to a heat sink, which is efficient in transferring heat away from the printhead. The efficiency of the heat transfer away from the printhead will be aided increasingly, the cooler the heat sink is relative to the printhead. Because of the range of ambient temperatures to be encountered (assumed to be 5° C. to 35° C., but not limited to that range), because of the temperature uniformity requirement, and because it is less complicated (cheaper) to control temperature by heating than by cooling, it is advantageous to set the nominal printhead operating temperature at or near the maximum ambient temperature encountered. Because of the desired minimal first copy (print) out time, as well as the desired efficiency of the heat sink, it is also advantageous to situate the temperature sensor and heater as close as possible (thermally) to the printhead, and as far as possible (thermally) from the heat sink.

Various techniques are known in the prior art to control heat buildup and maintain the printhead within a reasonable printing temperature range. U.S. Pat. No. 4,496,824 to Kawai et al. discloses a thermal printer which includes circuitry to measure printhead temperature, compare the temperature to values representing a desired temperature range and reduce the printhead temperature by activation of a cooling mechanism.

U.S. Pat. No. 4,571,598 discloses a thermal printhead in which a heat sink and ceramic substrate are connected to heating elements formed on the substrate surface.

More exact temperature regulation is obtained, however, by using a combination of a temperature sensor and a heater in a feedback loop tied into the printhead power source. For example, U.S. Pat. No. 4,250,512 to Kattner et al. discloses a heating device for a mosaic recorder comprised of both a heater and a temperature sensor disposed in the immediate vicinity of ink ducts in a recording head. The heater and sensor function to monitor and regulate the temperature of a recording head during operation. Column 3, lines 7–24 describes how a temperature sensor, a thermistor, a heating element, and a resistor operate in unison to maintain the recording head at an optimum operational temperature to maximize printing efficiency. U.S. Pat. No. 4,125,845 to Stevenson, Jr. discloses an ink jet printhead temperature control circuit which uses a heater and a temperature sensing device to maintain a recording head temperature above the preset temperature level. An output from the temperature sensing device drives an electrical heater which regulates the recording head temperature. The temperature sensing device is a resistive element attached to the bottom side of the printhead by thick film techniques. U.S. Pat. No. 4,704,620 to Ichihashi et al. discloses a temperature control system for an ink jet printer wherein the temperature of an ink jet printhead is controlled by a heater and a temperature sensor which collectively regulate heat transfer to maintain an ink jet printhead within an optimum stable discharge temperature range. The temperature control circuit as shown in FIG. 7 of the patent, utilizes an output from a comparator circuit and control signals from a signal processing circuit to regulate printhead temperature based on the output from the temperature sensor. U.S. Pat. No. 4,791,435 to Smith et al. discloses a thermal ink jet printhead temperature control system which regulates the temperature of a printhead via a temperature sensing device and a heating component. The temperature sensing device, comprised of either a collection of transducers or a single thermistor closely estimates the temperature of the ink jet printhead and compensates for an unacceptable low printhead temperature by either cooling or heating the printhead as needed. U.S. Pat. No. 4,686,544 to Ikeda et al. discloses a temperature control system for "drop-on-demand" ink jet printers wherein a heat generating electrode, positioned between layers of insulating and resistive material of a printhead substrate, controls the temperature of the printhead during operation, Column 4, lines 7–25, describes how an electrothermal transducer delivers the heat required to maintain the ink jet printhead at an optimum temperature level to maximize efficiency printing efficiently. U.S. Pat. No. 4,636,812 to Bakewell, while disclosing a thermal printhead, also teaches using a heater and temperature sensor supported within a laminated layer near the marking resistors.

The above references disclosing the heater and temperature sensor combination may not be suitable for some printing systems depending on factors such as printhead geometry, print speed, ambient operating temperature range, etc.. Further, more exact regulation may be required which is not achievable with the prior art structures. The ideal solution is to form the heater and sensor in close proximity to the printhead in an inexpensive and simple manner. The present invention is directed towards a printhead heat control structure wherein the heater and temperature sensor are formed on the same substrate as that on which the printhead is mounted using thick film screen printing and firing techniques. In a preferred embodiment a metal substrate is used with dielectric and conductive layers formed on a recess in its surface by a selective printing process. More particularly, the invention relates to an improved temperature control system for an ink jet printer which includes an ink jet printhead bonded to an underlying heat sink substrate, the control system including a sensing means for sensing the temperature of said printhead, heater means thermally coupled to said printhead, and a heat sink member in thermal communication with said printhead; control means responsive to outputs from said temperature sensing means and adapted to provide or remove power from said heater means, the improvement wherein said temperature sensing means and heater means are resistive layers separated from said heat sink substrate and said printhead by dielectric layers.

DESCRIPTION OF THE INVENTION

Figure 1:
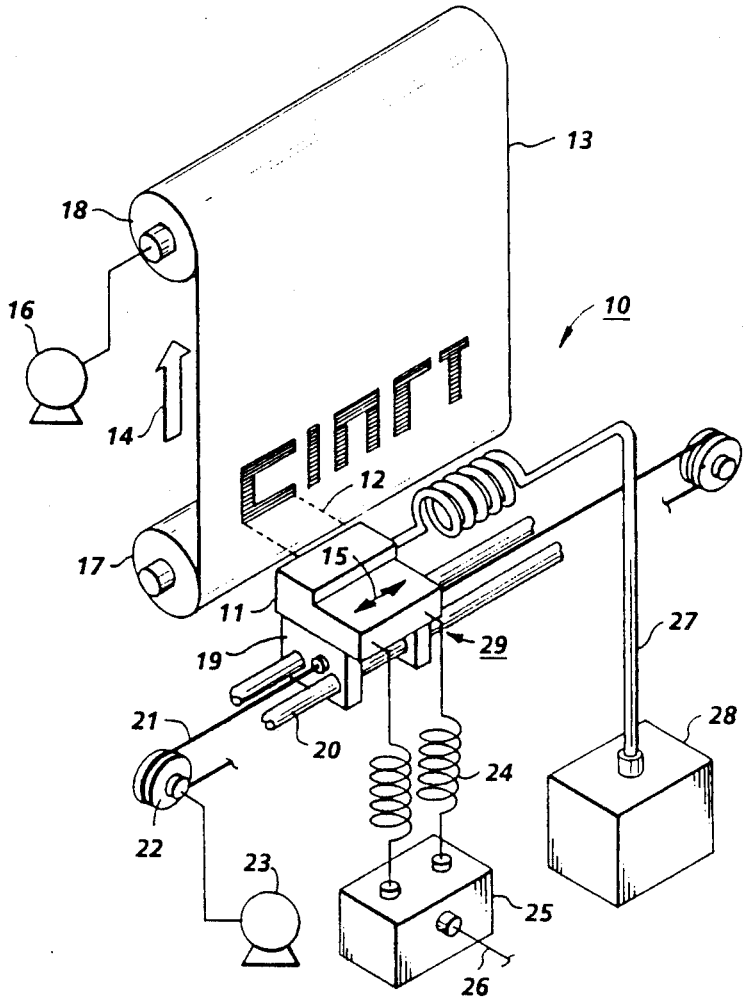
FIG. 1 (Prior Art)
FIG. 1 is a schematic perspective view of a bubble ink jet printing system incorporating the present invention.

A typical carriage type bubble jet ink printing device 10 is shown in FIG. 1. A linear array of droplet producing bubble jet channels is housed in the printhead 11 of reciprocating carriage assembly 29. Droplets 12 are propelled to the recording medium 13 which is stepped by stepper motor 16 a preselected distance in the direction of arrow 14 each time the printing head traverses in one direction across the recording medium in the direction of arrow 15. The recording medium, such as paper, is stored on supply roll 17 and stepped onto roll 18 by stepper motor 16 by means well known in the art.

The printhead 11 is fixedly mounted on support base 19 which is adapted for reciprocal movement by any well known means such as by two parallel guide rails 20. The printing head and base comprise the reciprocating carriage assembly 29 which is moved back and forth across the recording medium in a direction parallel thereto and perpendicular to the direction in which the recording medium is stepped. The reciprocal movement of the head is achieved by a cable 21 and a pair of rotatable pulleys 22, one of which is powered by a reversible motor 23.

The current pulses are applied to the individual bubble generating resistors in each ink channel forming the array housed in the printhead 11 over electrical connections 24 from controller 25. The current pulses which produce the ink droplets are generated in response to digital data signals received by the controller through electrode 26. The ink channels are maintained full during operation via hose 27 from ink supply 28.

Figure 2:
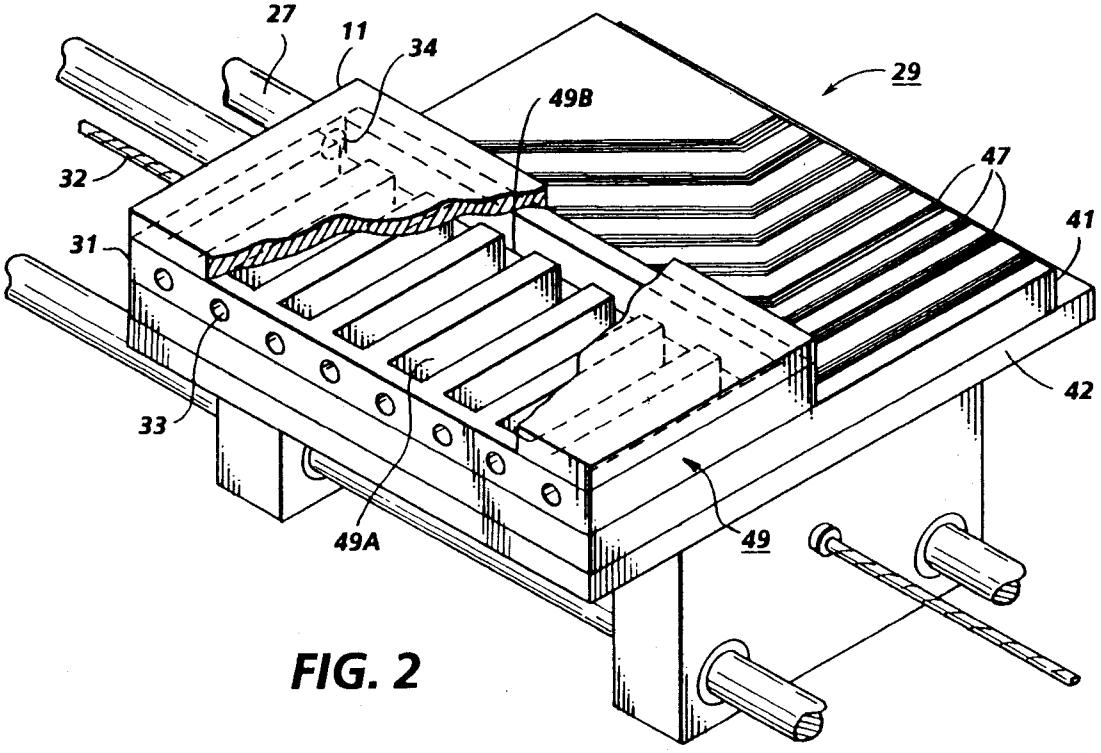
FIG. 2 is an enlarged schematic perspective view of the printhead of FIG. 1.

FIG. 2 is an enlarged partially sectioned, perspective schematic of the carriage assembly 29 shown in FIG. 1. The printhead 11 includes substrate 41 containing the electrical leads 47 and bubble generating resistors 44 (shown in FIG. 3). According to the invention, heat sink substrate 42, incorporating the heater and thermistor as described in further detail below is bonded printhead substrate 41. Printhead 11 also includes the channel plate 49 having ink channels **49*a* and manifold 49*b*. Although the channel plate 49 is shown in two separate pieces 31 and 32, the channel plate could be an integral structure. The ink channels 49*a* and ink manifold 49*b* are formed in the channel plate piece 31 having the nozzles 33 at the end of each ink channel opposite the end connecting the manifold 49*b*. The ink supply hose 27 is connected to the manifold 49*b* via a passageway 34 in channel plate piece 31 shown in dashed line. Channel plate piece 32 is a flat member to cover channel plate piece 31 and together form the ink channel 49*a* and ink manifold 49*b* as they are appropriately aligned and fixedly mounted on substrate 41**.

Figure 3:
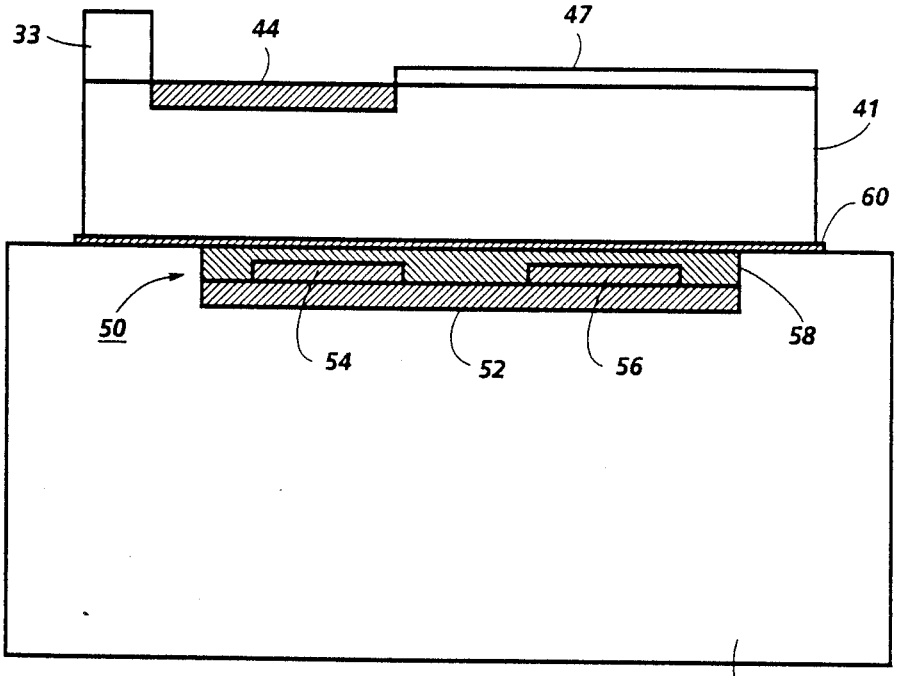
FIG. 3, is is a cross-sectional side view of the printhead shown in FIG. 2.
Figure 4:
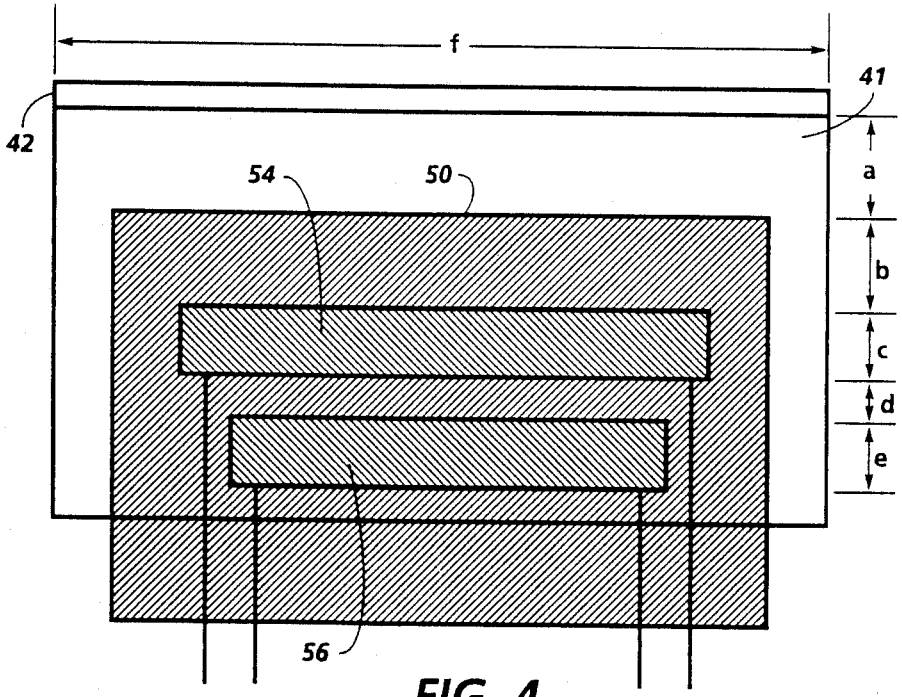
FIG. 4 is a top plan view of the printhead shown in FIG. 3.

Referring now to FIGS. 3 and 4, FIG. 3 shows, not to scale, a cross-sectional side view of substrate 41 and 42 of FIG. 2. Substrate 41 contains a plurality of heating resistor elements 44 which are pulsed by signals sent along electrodes 47 to heat and expel ink from nozzles 33. Substrate 41 is bonded to heat sink substrate 42 which, can be copper or other heat conductive material. Substrate 42, in a preferred embodiment, has a recess 50 in the top surface. An underglaze dielectric layer 52 has been screened on to the bottom of recess 50.

Recess 50, which can be formed by a machining operation by coining, or by selective etching, is preferably from 2–7 mils deep. Resistive layers 54 and 56 form the heater and temperature sensors, respectively; these layers are formed on layer 52 by a thick film screen printing process. The leads to these layers (FIG. 4) extend from layers 54, 56, and from recess 50 out into an exposed area for connection to the power source. Overglaze dielectric layer 58 covers layers 54 and 56 and their leads. The printhead substrate 41 is bonded to the three non-recess sides of the recessed area by die bond layer 60. Bond layer 60 is assumed to be thermally conductive and may also be electrically conductive, if it is desired to hold the back of the printhead at the same potential as the substrate. This configuration allows good thermal contact between the printhead and the metal substrate in a limited, but critical area near the front of the device, so that the most direct thermal conduction path from the heaters is maintained. This configuration also allows precise positioning of the printhead with the metal surface as a reference. In a preferred embodiment underglaze dielectric layer 52-L is thicker than overglaze layer 58 placing the heater and sensor layers closer to the printhead than to the metal substrate. The temperature sensor 56 (thermistor) is made of a thick film material having a large temperature coefficient of resistance. Heater layer 54 may be a standard thick film resistor or, to conserve screen printing, it may be the same material as layer 50.

Referring to FIG. 4, there is shown a top plan view of the printhead of FIG. 3 showing distances and widths from the edge of the array to the end of the recessed area. The letters refer to the following features: (a) is the size of the portion of heat sink substrate 42 extending under the front of the printhead; (b) is the distance between the beginning of the recess 50 and heater 54; (c) is the width of the heater 54; (d) is the space between heater 54 and sensor 56; (e) is the width of the sensor 56, and (f) is the length of the printhead. In the preferred embodiment, the printhead width (a+b+c+d+e) is approximately 0.1", while f is somewhat longer. If the space available is apportioned equally among a, b, c, d and e, then they will each be about 0.02".

Figure 5:
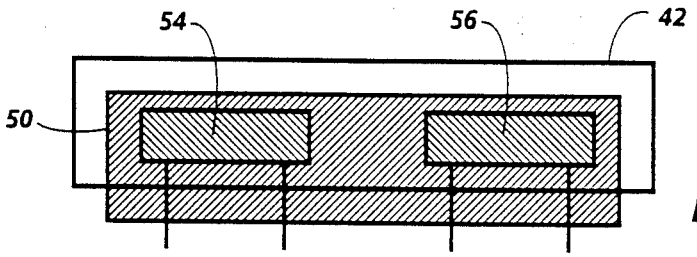
FIG. 5 is an enlarged top plan view of a second embodiment of the heater and thermistor layers.
Figure 6:
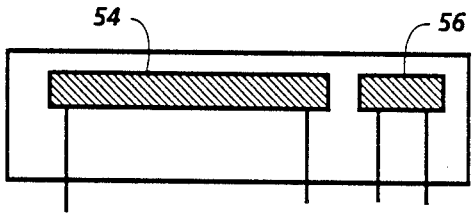
FIG. 6 represents another embodiment showing different locations for the heater and temperature sensor components.
Figure 7:
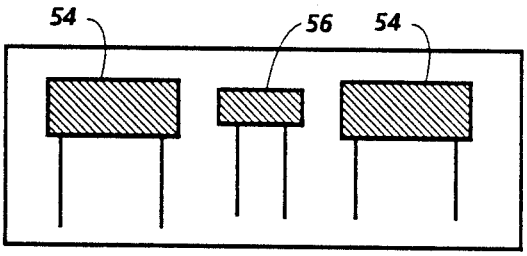
FIG. 7 is a still further embodiment showing alternate locations for the heater and temperature sensor components.

A second embodiment of the invention is shown in FIG. 5. Here, heater 54 and thermistor 56 are formed adjacent to each other and in the same plane to ease tolerances by omitting distances d and e (compared to the FIG. 4 embodiment) so more space is available for distances a, b, and c. Other possible geometries, depending upon system requirements, are to form a long heater layer with a shorter thermistor at one end (FIG. 6), or to form a pair of larger heaters at each end with the smaller sensor positioned midway (FIG. 7).

Figure 8:
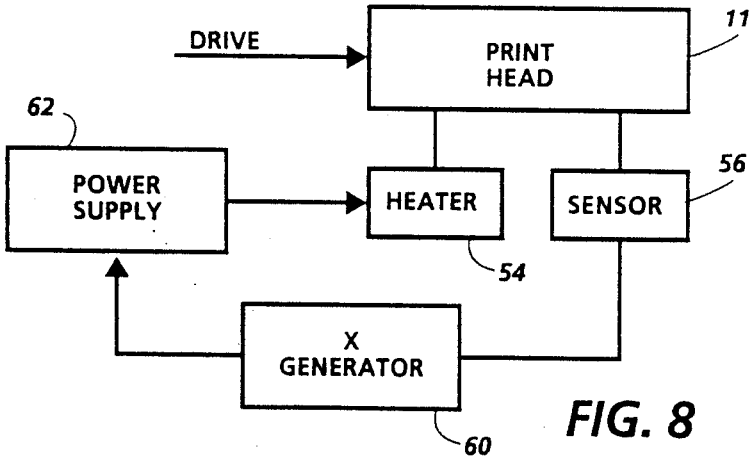
FIG. 8 is an electrical control block diagram showing the feedback loop for controlling temperature of the printhead.

A control circuit block diagram for the FIGS. 3 to 7 embodiments is shown in FIG. 8. Outputs from temperature sensor 56 are sent to a comparison circuit 60 where the signal is compared to a high or low level temperature reference. If the sensed printhead temperature is below the reference value, a signal is sent to power supply 62 turning heater power off. If the temperature sensed is too high, heater power is turned on.

While the invention has been described with reference to the structure disclosed, it is not confined to the specific details set forth. As one example, the heater layer 54 and sensor layer 56 (FIG. 3) rather than being formed in parallel in the same horizontal plane, could be formed one above the other. Also, although a metal heat sink substrate was used in this preferred embodiment, other substrates may be used consistent with the deposition of thick film screened patterns thereon. Further, while a carriage was shown with a single printhead, the invention may be used in other configurations such as page width printers. As a still further example, the recess may be omitted for certain applications with the heater and sensor formed on the surface of the printhead substrate still, however, separated by a dielectric layer.

What is claimed is:

1. An improved temperature control system for an ink jet printer which includes an ink jet printhead bonded to an underlying heat sink substrate, the control system including a sensing means for sensing the temperature of said printhead, heater means thermally coupled to said printhead, and a heat sink member in thermal communication with said printhead; control means responsive to outputs from said temperature sensing means and adapted to provide or remove power from said heater means, the improvement wherein said temperature sensing means and heater means are resistive layers separated from said heat sink substrate and said printhead by dielectric layers.

2. The control system of claim 1 wherein said heat sink substrate has a recess formed in an area underlying said printhead and wherein said temperature sensing means and heater means are formed in said recess.

3. The control system of claim 1 wherein said temperature sensing means and heater means are formed on the surface of said heat sink substrate.

4. The control system of claim 1 wherein said heater resistive layer and said temperature sensing resistive layer are formed by thick film screening process.

5. The control system of claim 1 wherein the dielectric layer separating the temperature sensing resistive layer and the heater resistive layer from the printhead is thinner than the dielectric layer between the same resistive layers and the heat sink substrate surface.

6. The control system of claim 1 wherein the heater resistive layer is adjacent to, and in the same plane as, the temperature sensing resistive layer.

7. The control system of claim 1 wherein the heater resistor layer and the temperature sensing resistive layer are formed parallel to and in separate, adjacent vertical planes.

8. The control system of claim 1 wherein the heater resistive layer is longer than the temperature resistive layer.

9. In an ink jet printer, a printhead comprising a substrate which incorporates ink heating resistors adapted to heat ink supplied thereto by an ink channel and manifold assembly, and further comprising a heat sink substrate bonded to said heating resistive substrate, said heat sink substrate incorporating a heater resistive layer and a temperature sensing resistive layer separated from said ink heating resistor substrate and said heat sink substrate by dielectric layers.

10. The printer of claim 9 wherein said heater resistive layer and said temperature sensing resistive layers are formed by a thick film screen printing process.

11. The control system of claim 1 wherein the heater resistive layer is parallel to the temperature sensing resistive layer.

* * * * *